United States Patent [19]

Nomura et al.

[11] 4,345,832

[45] Aug. 24, 1982

[54] AUTOMATIC FILM DEVELOPER HAVING A FILM GUIDE MEANS

[75] Inventors: Norimasa Nomura, Kyoto; Yasuhito Yoshimi, Mukou, both of Japan

[73] Assignee: Dainippon Screen Seizo Kabushiki Kaisha, Kyoto, Japan

[21] Appl. No.: 132,782

[22] Filed: Mar. 24, 1980

[30] Foreign Application Priority Data

Apr. 11, 1979 [JP] Japan ..... 54-48085[U]

[51] Int. Cl.[3] ..... G03D 3/12

[52] U.S. Cl. ..... 354/320; 354/338; 354/339; 226/170; 226/196

[58] Field of Search ..... 354/320, 321, 322, 338, 354/339, 316; 134/64 P, 122 P, 125; 226/170, 196, 197, 198, 199; 118/428

[56] References Cited

U.S. PATENT DOCUMENTS

| | | | |
|---|---|---|---|
| 2,786,401 | 3/1957 | Briggs et al. | 354/320 |
| 2,927,503 | 3/1960 | Zollinger | 354/321 |
| 3,388,688 | 6/1968 | Stanton | 354/322 |
| 3,492,933 | 2/1970 | Knibiehly et al. | 134/122 P |
| 3,656,676 | 4/1972 | Hope et al. | 354/321 |
| 3,824,616 | 7/1974 | Uchida | 354/339 |
| 4,131,356 | 12/1978 | Schmidt | 354/339 |
| 4,174,901 | 11/1979 | Takito et al. | 354/322 |

FOREIGN PATENT DOCUMENTS

| | | | |
|---|---|---|---|
| 1013511 | 8/1957 | Fed. Rep. of Germany | 354/339 |

*Primary Examiner*—L. T. Hix
*Assistant Examiner*—Alan Mathews
*Attorney, Agent, or Firm*—Zarley, McKee, Thomte, Voorhees & Sease

[57] ABSTRACT

An automatic film developer having a film guide means, wherein a film exposed is developed while it is conveyed in a developing liquid in a liquid tank, and then the film developed is taken out of the liquid along a contact surface of a film guide means in order to be transferred to a next process, and wherein the film guide means is provided with a recess in its contact surface so that the film may be separated from the contact surface in the recess portion.

2 Claims, 6 Drawing Figures

CONVENTIONAL FILM GUIDE

CONVENTIONAL FILM GUIDE

CONVENTIONAL FILM GUIDE

AUTOMATIC FILM DEVELOPER HAVING A FILM GUIDE MEANS

BACKGROUND OF THE INVENTION

This invention relates to an automatic film developer having a film guide means, which prevents uneven finish during development.

In a conventional automatic film developer, when a film developed in a developing tank is taken out of a developing liquid, the film is partly over-developed in its contact surface portions with crossover guide plates which lead the film come out of the liquid to transfer rollers, with the result of uneven finish of the streaking, by the developing liquid held between the surface of the film and the lower surfaces of the crossover guide plates by the surface tension and the capillary action of the liquid.

SUMMARY OF THE INVENTION

It is an object of the present invention to provide an automatic film developer having a film guide means free from the abovementioned defect, which is simple and reliable.

According to the present invention there is provided an automatic film developer having a film guide means, comprising a liquid tank in which a developing liquid is contained, a belt, movably mounted in the tank, which conveys a film fed in the tank in the developing liquid while the film is developed, and a film guide means having a contact surface in its one side, part of which is immersed in the liquid, and which along the contact surface the film taken out of the liquid is moved in order to be transferred to a next process, characterized in that the contact surface is provided with a recess so that the film may be separated from the contact surface in the recess portion.

BRIEF DESCRIPTION OF DRAWINGS

The present invention will become more fully understood from the following description of some preferred embodiments thereof, taken in conjunction with the accompanying drawings, in which.

DESCRIPTION OF PREFERRED EMBODIMENTS

Figure 1:
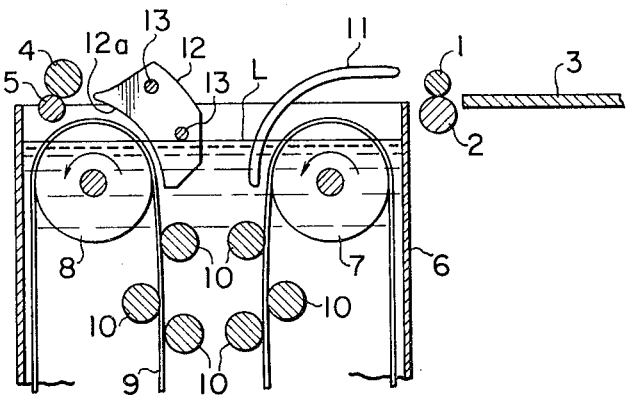
FIG. 1 is a fragmentary longitudinal cross-section of a conventional film developer.
Figure 2:
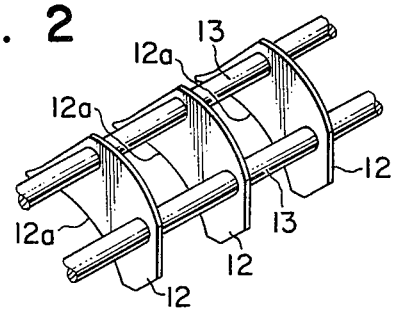
FIG. 2 is a perspective view of crossover guide plates in FIG. 1.
Figure 3:
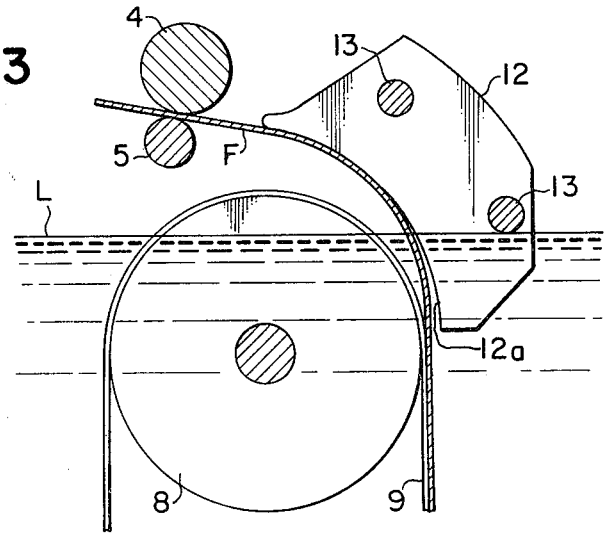
FIG. 3 is an enlarged longitudinal cross-section of the crossover guide plates portion in FIG. 1.

Referring to the drawings, there is shown in FIGS. 1–3 a conventional film developer (only the upper portion is shown). A pair of upper and lower feed rollers 1 and 2 together with a feed tray 3, and a pair of upper and lower transfer rollers 4 and 5 are arranged in both upper sides of a developing tank 6 in which a developing liquid L is contained.

In the tank 6 upper pulleys 7 and 8 and lower pulleys (not shown) are rotatably mounted in its upper and lower portions. The upper pulleys 7 and 8 are usually projected partly from the surface of the developing liquid L. Between the upper and the lower pulleys perforated belts 9 such as mesh belts are extended, and are supported by guide rollers 10. A feed guide member 11 and crossover guide plates 12 which are linked one another at a certain distance by horizontal link rods 13, are positioned above the upper pulleys 7 and 8. The crossover guide plates 12 lead a film F taken out of the developing liquid L to the transfer rollers 4 and 5.

Each crossover guide plate 12 having an arc-shaped lower contact surface **12*a* comprises a thin stainless steel plate, a plastic plate, or the like. The lower end portion of the arc-shaped contact surface 12*a* of the crossover guide plate 12 is generally formed in a coaxial arc shape with respect to the upper pulley 8, and first contacts with the film F taken out of the liquid by the belt 9. The crossover guide plates 12** are partly immersed in the liquid.

In such a conventional developer, however, when the film developed is taken out of the developing liquid, the parts of the film F are usually over-developed in its contact surface with the crossover guide plates 12, with the result of uneven finish of the streaking, by the developing liquid F held between the surface of the film F and the contact surfaces **12*a* of the crossover guide plates 12** by the surface tension and the capillary action of the liquid.

Figure 4:
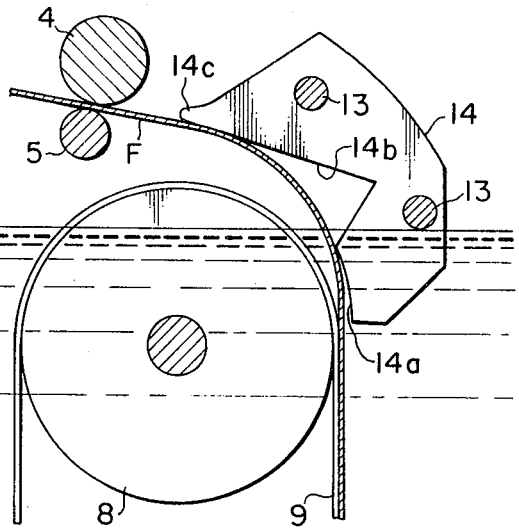
FIG. 4 is an enlarged longitudinal cross-section of a film guide means portion of an automatic film developer according to the present invention.

In FIG. 4, there is shown an essential part of an automatic film developer according to the present invention, which is almost the same as the conventional one shown in FIGS. 1–3, except film guide plates 14 instead of the crossover guide plates 12.

Each film guide plate 14 is provided with a recess **14*b* in its lower contact surface 14*a* so that the film F taken out of the developing liquid L may be separated from the film guide plate 14 in the recess portion. Therefore, when the film is taken out of the liquid, it is not accompanied with the liquid held between the surface of the film F and the contact surfaces 14*a* of the film guide plates 14, thereby preventing the film from the uneven finish. Then, the film is again contacted with the contact surfaces 14*a* of the film guide plates 14 at their rear ends 14*c* wherein the film is contacted at a short time with the film guide plates 14 and is accompanied with only a small amount of the liquid on its surface. Hence, the uneven finish cannot be caused in the rear end portions of the film guide plates 14**, neither.

Figure 5:
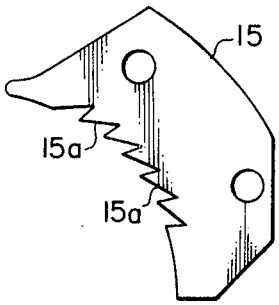
FIGS. 5 and 6 show other film guide means according to the present invention.
Figure 6:
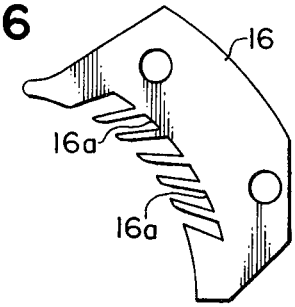

In FIGS. 5 and 6, there are shown other embodiments of film guide plates 15 and 16 which are provided with a plurality of recesses **15*a* and 16*a***, respectively, in their contact surfaces, like a saw and a comb, according to the present invention. In these cases, the same effects or the more effects as or than the first embodiment described above can be obtained.

Although the present invention has been shown and described with respect to some preferred embodiments thereof, it should be understood that various changes and modifications of the form and the content thereof may be made by those skilled in the art, without departing from the scope of the present invention.

What is claimed is:

1. An automatic film developer having a film guide means, comprising:

a liquid tank in which a developing liquid is contained;

a belt, movably mounted in the tank, which conveys a film fed in the tank in the developing liquid while the film is developed; and a film guide means having a contact surface in its one side, part of which is immersed in the liquid, and which includes a plurality of recesses over the majority of the portion of the length of said surface which is out of the liquid, whereby film which is transferred along said contact surface may be separated from said contact surface in the recess portions.

2. A developer as claimed in claim 1, wherein said contact surface includes a plurality of teeth whereby said plurality of recesses is formed therebetween.

* * * * *